United States Patent [19]

Johnson

[11] Patent Number: 4,943,896

[45] Date of Patent: Jul. 24, 1990

[54] PRODUCTION OF IMPROVED INFANT CARE ARTICLES

[76] Inventor: Tony Johnson, Rte. 4, Box 4471, Bullard, Tex. 75757

[21] Appl. No.: 273,904

[22] Filed: Nov. 21, 1988

[51] Int. Cl.[5] ..... F21V 9/16

[52] U.S. Cl. ..... 362/84; 362/103

[58] Field of Search ..... 362/84, 103, 108; 250/459.1; 2/80; 215/11.1; 128/360

[56] References Cited

U.S. PATENT DOCUMENTS

| | | | |
|---|---|---|---|
| 3,635,832 | 1/1972 | Toney | 362/84 |
| 4,623,068 | 11/1986 | Brown et al. | 215/11.1 |
| 4,688,571 | 8/1987 | Tesler | 128/360 |
| 4,759,453 | 7/1988 | Paetzold | 215/11.1 |

FOREIGN PATENT DOCUMENTS

| | | | |
|---|---|---|---|
| 2594328 | 8/1987 | France | 128/360 |
| 2169811 | 7/1986 | United Kingdom | 128/360 |

*Primary Examiner*—Ira S. Lazarus
*Assistant Examiner*—Sue Hagarman
*Attorney, Agent, or Firm*—Ronald B. Sefrna

[57] ABSTRACT

The present invention provides a method of producing improved infant care articles characterized by the inclusion of a non-toxic, non-irritating phosphorescent material with the material of construction of components of the infant care articles so that such components phosphorescently emit light visible in a darkened environment, allowing the location and position of the articles to be readily determined without the need for an additional light source. Embodiments of infant care articles produced in accordance with the invention, including infant pacifiers, bottle assemblies, and clothing, are disclosed.

19 Claims, 1 Drawing Sheet

PRODUCTION OF IMPROVED INFANT CARE ARTICLES

FIELD OF THE INVENTION

The present invention generally relates to infant care articles, and in its preferred embodiments more specifically relates to the production of improved infant care articles adapted to phosphorescently emit light in a darkened room to facilitate identification of their location and position.

BACKGROUND OF THE INVENTION

The use of infant care products such as pacifiers, or orthodontic exercisers, and baby bottles to help infants fall asleep and to soothe them during periods of restless sleep has become very common. Almost equally common is the problem of locating those products in and around the infant's bed after the infant has fallen asleep, without lighting the room and taking the risk of awakening the infant. Other difficulties encountered by parents and other infant caregivers arise from the need to check the position of a sleeping infant from time to time without lighting the room and awakening the infant, and to determine whether a sleeping infant is adequately covered for warmth without lighting the room and awakening the infant.

The infant care articles mentioned above, such as pacifiers, bottles and nipples, nipple retainer rings, and nipple covers, are well known, but none of those known articles provide any means of visibility in a darkened room, and it has been necessary to either light the room in which those articles are to located or to use a focused beam of light such as produced by a small flashlight in order to locate those items by sight. No known attempt has been made to aleviate this problem by adapting those articles to be light emitting, for example, though various uses of light emitting items are known in the art for different purposes. For example, U.S. Pat. No. 4,433,364 to Noble discloses a lighted handgrip, using a battery powered light bulb; U.S. Pat. No. 4,563,726 to Newcomb et.al. discloses a chemiluminescent drinking mug and U.S. Pat. No. 4,086,723 to Strawick discloses a chemiluminescent flying saucer toy, both using a chemiluminescent "light stick"; U.S. Pat. No. 4,413,588 to Lindholm discloses an animal restraint collar which may be made reflective or fluorescent; and U.S. Pat. No. 1,438,839 discloses an easily removeable luminous indicating button for keys. The use of reflective clothing or clothing patches for adults and older children is also known, intended primarily to make the wearer readily visible in vehicle headlights for safety purposes.

All of the approaches to light emission disclosed by the noted prior art are unsuitable for use with articles intended for infants, for various reasons. The use of an electrically powered light bulb has inherent safety risks, as well as problems with weight and bulk. Chemiluminescent "light sticks" and the like, which emit light during the progress of a chemical reaction, are single use items which emit light during a relatively short period, especially when the volume of chemical reactants is small. Reflective or fluorescent materials emit only in the presence of impinging light energy.

Thus there has remained an unfilled gap in the art, relating to the provision of safe, effective, long lasting infant care articles which are adapted to emit a "soft" or low level, unobtrusive light for an extended period of time without the use of bulbs and power sources, and without dependence upon ongoing chemical reactions or upon continued impingement of excitation energy for such emission.

SUMMARY OF THE INVENTION

The present invention provides a process of producing infant care articles and various embodiments of such articles produced in accordance with the invention, designed to meet the need identified in the art by adapting the articles to emit low intensity light without alteration of the configuration or weight of the articles from that found to be most effeCtive for infant use, and without the use of toxic or otherwise potentially hazardous materials.

The conceptual basis of the invention is the inclusion of a non-toxic phosphorescent material in the material of construction of at least certain components of infant care articles which are desired to be made visible during conditions of darkness In the general process of the invention, the selected phosphorescent material is used as an additive to the material of construction for such articles when such material is prepared for use in preparation of the desired article. The scope of the invention is not limited to the production of any one specific component of any particular infant care article, or to the components and article embodiments illustrated In the following disclosure, and the invention may be employed in conjunction with a wide variety of infant care products as will be recognized by practitioners in the art.

The phosphorescent material used in the process of the invention must be systemically non-toxic to infants in the event of ingestion, despite the low probability of ingestion, and must also be non-irritating to the skin and mouth tissues upon surface contact. The material should exhibit the properties of true phosphorescence, characterized by continued emission of light for a substantial period after cessation of impingement of exciting radiation, rather than fluorescence, in which emission of light ceases immediately upon removal of the exciting radiation.

With infant care articles such as pacifiers, the phosphorescent material is utilized as an additive to the moldable plastic material used to form the guard, and optionally a grasping ring, portion of the pacifier construction. When used in the process of construction of a bottle assembly, the material is utilized as an additive to the moldable plastic material used to form the nipple retainer ring component, and may be similarly used in the formation of a nipple cover component and in the formation of the bottle component itself. The nipple portion of the pacifier, and the nipple to be used with the bottle, which are typically formed of a latex or other rubber-like material, preferably do not receive the phosphorescent additive.

The invention is also useful for the production of thin, elongate phosphorescent fibers which may be utilized in desired locations in the creation of infant sleep-wear. More specifically, the fibers produced in accordance with the invention may be interwoven with other fibers during the formation of such articles of infant clothing, especially at the neck and/or cuff areas, or in discrete bands spaced through the length of the articles of clothing. The provision of neck and cuff bands allows an adult supervising the infant to readily identify the position of the infant in its bed through visibility of the phosphorescent fibers, without the need to light the room in which the infant is sleeping. In a closely related use, the phosphorescent material may be used in the production of elongate ribbons or the like, which may be interwoven with the general material of construction of infant clothing articles in desired locations to achieve the desired effect. The same effect may also be obtained by the process of adding phosphorescent bands or other indicia to infant clothing by a screening or other printing or texturing process, in which the phosphorescent material is used as an additive in a suitable fabric printing dye or other printing media or in a flockulant or texturing material to be applied to the clothing fabric.

The process of the invention and its use in the production of infant care articles is described in more detail below, with reference to the accompanying illustrative drawing figures.

DETAILED DESCRIPTION OF THE INVENTION

Infant care articles adaptable to production in the improved form in accordance with the invention share the common characteristic of including one or more components which are readily susceptible to the inclusion of pigments or colorants during their production process. For purposes of this disclosure, those articles may conveniently be divided into two categories: infant care devices, including pacifiers and bottle assemblies; and infant clothing.

The improved infant care articles of the first category produced in accordance with the invention comprise components formed of a meltable plastic material, suitable for molding or extrusion, withln which a non-toxic, non-irritating phosphorescent material is incorporated during preparation of the plastic material for formation of the selected components. The phosphorescent material may be used as one part of a colorant mixture, or may comprise the only colorant additive introduced to the plastic material during the process of production of the infant care article components.

Because the articles produced in accordance with the invention are intended for use with infants and will be in close contact with the skin and, to some degree, the mouth tissues of the infants, the use of phosphorescent materials of a non-toxlc and non-irritating nature is of significant importance. The phosphorescent material should also be of a formulation which responds readily and quickly to excitation by daylight, incandescent light, and fluorescent light, and which phosphorescently emits light for a substantial period after removal of the excitation energy. Inorganic phosphorescent compounds having a zinc sulfide chemical base, such as phosphorescent pigments manufactured and sold by USR Optonix Inc., of Beattystown, New Jersey, under the tradename "EXCITE", are an example of phosphorescent materials which have been found to meet the noted criteria, and are suitable for use in practice of the invention. Such phosphorescent materials are available in a variety of asthetically satisfactory colors For example, the inorganic phosphorescent compound marketed as EXCITE 2330 has a pale green daylight color and emits a brighter green light upon excitation, such that infant care articles incorporating that material provide an unobtrusive color in a lighted environment, yet emit sufficient light energy in a darkened environment to be readily identified.

The phosphorescent material must also have a sufficiently high melting point to maintain its integrity when mixed with molten plastic construction material for production of the infant care article components, and must be resistant to chemical degradation by the plastic construction material. The inorganic zinc sulfide based phosphorescent compounds noted above have a melting point in excess of 1000 degrees C., which is substantially above the melting point of typically used plastic construction materials, and are not subject to chemical degradation by such materials.

Figure 1:
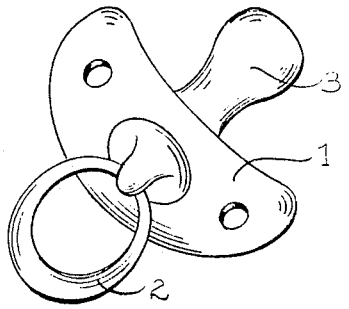
FIG. 1 is a perspective view of an infant pacifier device readily adaptable to production in accordance with the invention.
Figure 2:
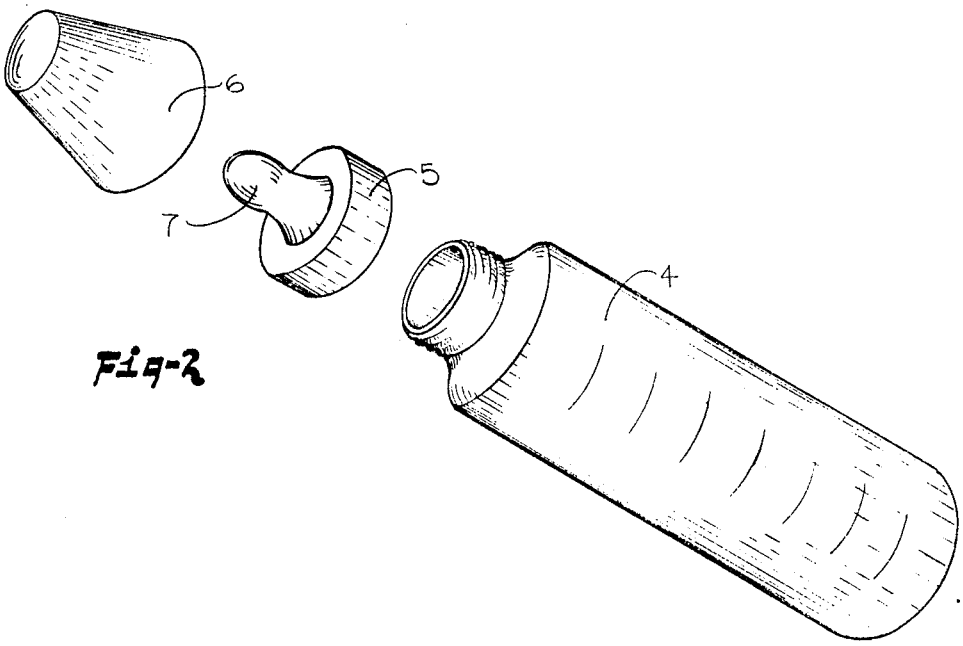
FIG. 2 is a perspective view of an infant bottle assembly readily adaptable to production in accordance with the invention.

Referring now to specific embodiments of infant care articles in accordance with the invention, FIGURE 1 illustrates an infant pacifier device, generally comprising a guard component 1, grasping ring 2, and nipple 3. FIG. 2 illustrates an infant bottle assembly, generally comprising the bottle component 4, nipple retainer ring 5, nipple cover 6, and nipple 7. Nipples 3 and 7 are typically constructed of a latex or similar rubberlike material, and are the components most commonly introduced into the mouth of the infant In the practice of the invention, guard component 1 and grasping ring 2 of the pacifier, and nipple retainer ring 5 and nipple cover 6 of the bottle assembly are the preferred components for production with inclusion of phosphorescent material.

In the preferred embodiment of the invention those phosphorescently adapted components are produced by melting the plastic construction material, which also acts as the vehicle for the phosphorescent additive, adding the desired quantity of the selected phosphorescent material either alone or in conjunction with any other desired colorant additive, mixing the additive or additives into the plastic construction material to the extent necessary to produce a homogenous mixture, and introducing the mixture into a conventional plastics mold for production of the specific component. The relative proportion of phosphorescent material to structural material required to provide the desired degree of light emission will vary in relation to the specific phosphorescent material used, the type of structural material utilized, and the type and amount of any additional colorant used.

Though in the preferred embodiment the phosphorescent material is homogenously dispersed through the article components, the phosphorescent material may be dispersed in a separate vehicle and coated onto the previously produced component without departing from the scope of the invention. If desired, a non-toxic transparent non-phosphorescent coating may be applied to the outer surface of the phosphorescently adapted components, though the application of such a coating is not deemed necessary for safe use of the infant care articles.

Figure 3:
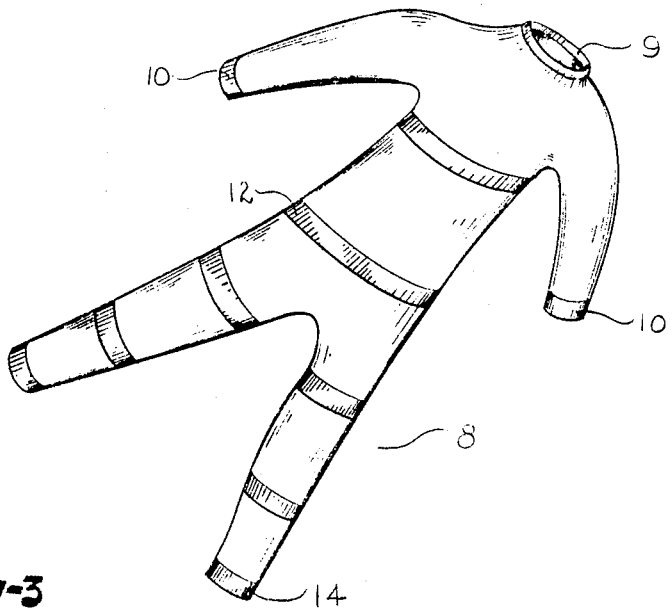
FIG. 3 is an illustration of an article of infant clothing produced in accordance with the invention.

The invention is also useful for the production of infant clothing having one or more phosphorescent bands or other phosphorescent indicia, for the purpose of identifying the position and/or degree of coverage of a sleeping infant in a darkened room FIG. 3 illustrates a typical item of clothing 8, having a phosphorescent neck band 9, phosphorescent sleeve bands 10, a plurality of spaced body bands 12, and leg bands 14. In one embodiment, the phosphorescent bands are produced by the interweaving of phosphorescent fibers with the fabric used for construction of the clothing. Suitable phosphorescent fibers may produced through the same steps disclosed above for production of molded components, with a change from introduction of the mixture to a mold to passage of the mixture through a suitable extrusion die. The pr!mary material of the phosphorescent fiber may be any synthetic fiber material suitable for at least limited use in infant clothing, such as nylon.

However, the zinc sulfide based phosphorescent compounds noted above are readily useable as a colorant additive to fabric printing inks and other fabric printing media, and the phosphorescent bands and other phosphorescent indicia are preferably produced by printing onto the fabric used for production of the clothing, either prior to final sewing of the clothing or as a final step in production of the items of clothing. The selected phosphorescent compound may also be mixed with a flockulant or texturing material, in combination with a suitable adhesive or binder, and with or without additional colorant additives, and applied to the infant clothing as an integral part of a texture design. This manner of printing and/or texture application allows phosphorescent indicia to be unobtrusively incorporated into the articles of clothing as a part of a wide variety of design elements limited only by the imagination of the clothing designer, without any loss of desired visibility in a darkened environment.

The foregoing disclosure and description is intended to be illustrative and not limiting, and it will be understood that additional embodiments and modifications of the invention may be made without departing from the scope and spirit thereof.

What is claimed is:

1. A process for producing infant care articles having one or more components formed of a plastic material by molding or extrusion, so that at least one of such components has the property of phosphorescent emission of light radiation visible to the human eye in a darkened environment, comprising the steps of selecting a non-toxic, non-irritating phosphorescent pigment material for addition to the plastic material from which one or more components of the infant care article is to be formed, such phosphorescent pigment material having a thermal decomposition point above the melting point of the plastic material and not being subject to chemical degradation by the plastic material;

then mixing a predetermined quantity of said phosphorescent pigment material with a predetermined quantity of said plastic material in a ratio selected to provide the desired intensity of phosphorescently emitted light;

then forming one or more components of the infant care article to be produced from said plastic material containing said phosphorescent pigment material by molding or extrusion;

then forming a transparent coating, of a non-toxic nonphosphorescent material, on the surface of said one or more components of the infant care article produced from said plastic material containing said phosphorescent pigment material, so as to provide a barrier between the phosphorescent pigment material and the user of the infant care article and prevent direct contact with said phosphorescent pigment material;

forming any remaining components of the infant care article to be produced; and then assembling all components of the infant care article to produce the finished article with one or more components having the property of phosphorescent emission of visible light.

2. The process of claim 1, wherein said phosphorescent pigment material comprises an inorganic zinc sulfide based pigment.

3. The process of claim 1, wherein the infant care article to be produced is an infant pacifier device, having a guard component formed of a plastic material, and the component of said infant pacifier device to be produced from said plastic material containing said phosphorescent pigment material and coated with said transparent coating comprises said guard component.

4. The process of claim 1, wherein the infant care article to be produced is an infant bottle assembly, having a nipple retaining ring component formed of a plastic material, and the component of said infant pacifier device to be produced from said plastic material containing said phosphorescent pigment material and coated with said transparent coating comprises said nipple retaining ring component.

5. The process of claim 1, wherein the infant care article to be produced is an infant bottle assembly, having a nipple cover component formed of a plastic material, and the component of said infant bottle assembly to be produced from said plastic material containing said phosphorescent pigment material and coated with said transparent coating comprises said nipple cover component.

6. A process of producing articles of infant clothing with at least a portion of each such article of infant clothing having the property of phosphorescent emission of light radiation visible to the human eye in a darkened environment, comprising the steps of selecting a plastic material suitable for the formation of elongate pigmented strands from a mixture of such plastic material and a pigment material;

selecting a non-toxic, non-irritating phosphorescent pigment material for mixture with the plastic material for the formation of elongate pigmented strands;

then mixing a predetermined quantity of said phosphorescent pigment material with a predetermined quantity of said plastic material in a ratio selected to provide the desired intensity of phosphorescently emitted light from strands formed of such mixture;

then forming one or more elongate phosphorescently pigmented strands from said mixture with said phosphorescent pigment material dispersed in said plastic material through such one or more strands; and then interweaving said one or more elongate phosphorescently pigmented strands into the material of construction of each of the articles of infant clothing in the portion of each of said articles of infant clothing from which the phosphorescent emission of light is desired.

7. The process of claim 6, wherein said elongate pigmented strands comprise mono-filament threads.

8. The process of claim 6, wherein said elongate pigmented strands comprise threads spun from a plurality of fibers.

9. The process of claim 6, wherein said elongate pigmented strands comprise yarn spun from a plurality of fibers.

10. A process of producing infant care article formed of one or more structural components of construction and having one or more non-structural design elements formed directly on at least one of such structural components of construction with at least one of such non-structural design elements having the property of phosphorescent emission of light radiation visible to the human eye in a darkened environment, comprising the steps of selecting a non-toxic, non-irritating phosphorescent pigment material for addition to the material from which the one or more non-structural design elements are to be formed, such phosphorescent pigment material being non-degradable by the material from which the one or more non-structural design elements are to be formed;

then mixing a predetermined quantity of said phosphorescent pigment material with a predetermined quantity of said material from which the one or more nonstructural design elements are to be formed, in a ratio selected to provide the desired intensity of phosphorescently emitted light to form a homogenous mixture of such materials; and Forming the at least one non-structural design element having the property of phosphorescent emission of visible light directly on at least one of the structural components by applying such mixture directly to such at least one structural component of construction of such infant care article.

11. The process of claim 10, wherein the infant care articles comprise articles of clothing.

12. The process of claim 10, wherein the infant care articles comprise articles of clothing, said one or more non-structural design elements comprise printed design elements, and said material from which said non-structural design elements are to be formed comprises a fabric printing media.

13. The process of claim 10, wherein the infant care articles comprise articles of clothing, said one or more non-structural design elements comprise texture design elements, and said material from which said non-structural design elements are to be formed comprises a flockulant or texture material and a binder or adhesive material.

14. The process of claim 10, wherein said phosphorescent pigment material comprises an inorganic pigment having a zinc sulfide chemical base.

15. In a process of producing infant care articles having one or more components formed from a plastic material, the improvement comprising adapting said infant care articles to phosphorescently emit light radiation visible to the human eye in a darkened environment by combining a phosphorescent pigment material with a coating vehicle and then applying said combined phosphorescent pigment material and coating vehicle to the surface of at least one of said one or more components and curing said coating vehicle after the formation of said one or more components to form a coating containing said phosphorescent pigment material on the exterior of at least one of said one or more components.

16. The improved process of claim 15, wherein said infant care articles comprise an infant pacifier device having a guard component and said one or more components to which said coating is to be applied comprise said guard component.

17. The improved process of claim 15, wherein said infant care articles comprise an infant bottle assembly having a nipple retainer ring component and said one or more components to which said coating is to be applied comprise said nipple retainer ring.

18. The improved process of claim 15, wherein said infant care articles comprise an infant pacifier device having a handle component and said one or more components to which said coating is to be applied comprise said handle component.

19. The improved process of claim 15, wherein said infant care articles comprise an infant bottle assembly having a nipple cover component and said one or more components to which said coating is to be applied comprise said nipple cover component.

* * * * *